United States Patent [19]

Hertzberg et al.

[11] Patent Number: 4,982,647

[45] Date of Patent: Jan. 8, 1991

[54] METHOD AND APPARATUS FOR INITATING STABLE OPERATION OF A RAM ACCELERATOR

[75] Inventors: Abraham Hertzberg, Bellevue; Adam P. Bruckner, Seattle, both of Wash.; David W. Bogdanoff, Mountain View, Calif.; Carl Knowlen, Seattle, Wash.

[73] Assignee: Washington Research Foundation, Seattle, Wash.

[21] Appl. No.: 207,706

[22] Filed: Jun. 16, 1988

[51] Int. Cl.[5] ..... F41F 1/00

[52] U.S. Cl. ..... 89/8; 102/523

[58] Field of Search ..... 89/8; 102/520, 523

[56] References Cited

U.S. PATENT DOCUMENTS 4,726,279 2/1988 Kepler et al. ..... 89/8

FOREIGN PATENT DOCUMENTS 248340 12/1987 European Pat. Off. ..... 89/8

OTHER PUBLICATIONS

Bruckner et al., "Ram Accelerator Direct Launch System for Space Cargo," 10/87.

Knowlen et al., "Performance Capabilities of the Ram Accelerator," 06/87.

Bruckner et al., "Investigation of Gasdynamic Phenomena Associated with the Ram Accelerator Concept," 06/87.

Hertzberg et al., "A New Chemical Method for Accelerating Projectiles to Ultrahigh Velocities," 11/86.

Hertzberg et al., "The Ram Accelerator: a New Chemical Method of Achieving Ultrahigh Velocities," 09/86.

*Primary Examiner*—Stephen C. Bentley

*Attorney, Agent, or Firm*—Christensen, O'Connor, Johnson & Kindness

[57] ABSTRACT

A method and apparatus for supersonically accelerating a projectile in a thermally choked subsonic combustion mode. A projectile (50) is initially preaccelerated using either a tank (24) of compressed helium or a chemical propellant charge preaccelerator (152). The projectile enters a portion of a tube (22) filled with a combustible mixture (54) of a gaseous fuel and an oxidizer and is propelled by a ram acceleration process as the mixture burns. In several different embodiments, various devices are used to control the velocity of a shock wave generated as the projectile enters the combustible mixture and the dynamic impulse pressure immediately behind the projectile, so that the shock wave attaches to the projectile along an aft portion, thereby establishing a stable subsonic combustion zone along the aft end (64) of the projectile, in which combustion of the gaseous fuel accelerates the projectile down the bore of the tube. In one embodiment, a perforated sabot (52) is used to propel the projectile during preacceleration. The sabot has a plurality of passages (114) extending longitudinally between its front and rear surfaces, which are initially closed with a thin plate (110) during the preacceleration of the projectile. However, the plate is dislodged as the projectile enters the combustible mixture, allowing the dynamic pressure of the shock wave caused by the sabot to dissipate through the open passages.

30 Claims, 2 Drawing Sheets

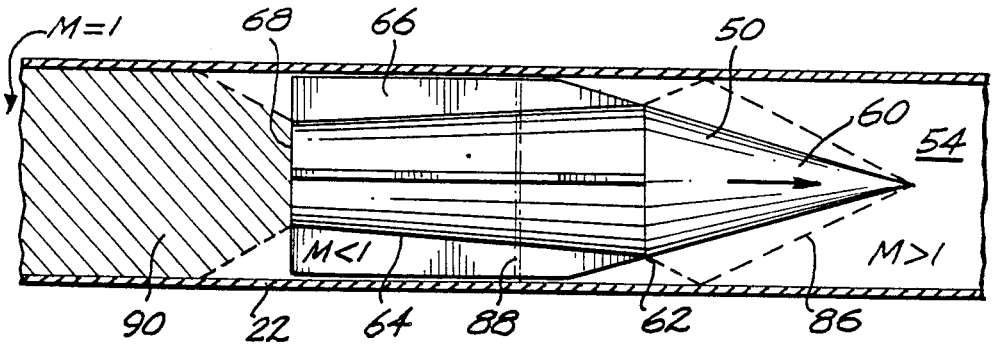
Fig. 2.
Fig. 8.
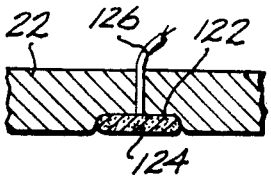
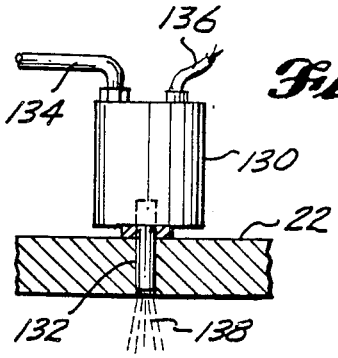
Fig. 9.
Fig. 3.
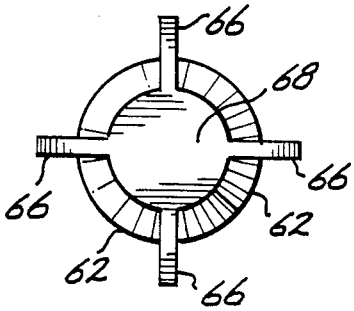
Fig. 6.
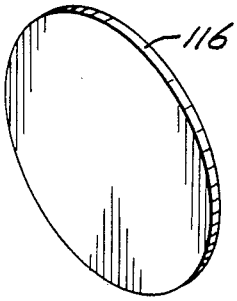
Fig. 7.
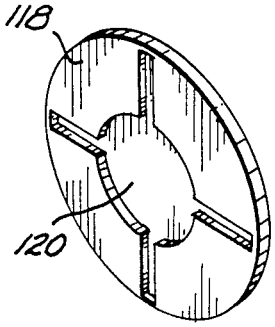

METHOD AND APPARATUS FOR INITATING STABLE OPERATION OF A RAM ACCELERATOR

TECHNICAL FIELD

The present invention generally pertains to a device for accelerating a projectile to supersonic velocities and, more specifically, to a device using a ram jet principle to propel the projectile.

BACKGROUND OF THE INVENTION

In a conventional cannon, a projectile is accelerated by the rapid expansion of gases resulting from the explosive combustion of propellant chemicals. The muzzle velocity of a projectile shot from a cannon is generally only slightly greater than the initial acoustic velocity of the expanding gases. This limitation results because the ballistic efficiency of the chemical propellant charge decreases rapidly as the driving gas expends most of its energy in accelerating itself. As used in the preceding statement, the term "ballistic efficiency" may be defined as the ratio of the rate of change of kinetic energy of the projectile to the rate of expenditure of chemical energy. It will thus be apparent that the decreasing ballistic efficiency inherently limits the acceleration of a projectile through the bore of a conventional cannon.

To overcome the limitation on projectile velocity imposed by driver gasdynamics, a new method for accelerating projectiles has been developed that does not use an exploding propellant charge, but instead continuously burns a combustible gaseous mixture to continuously accelerate a projectile in a method referred to as "ram acceleration." The new method is based on principles similar to those used in the air breathing ram jet engine, but is substantially different in many respects. For example, a ram jet engine carries with it a supply of fuel; in comparison, the projectile in a ram accelerator does not carry any propellant. Instead, the projectile travels through a tube filled with a mixture of gaseous fuel and an oxidizer compressed to several atmospheres of pressure. The tube functions like the outer cowling of a ram jet, and the profile of the projectile has a shape much like the center body of a ram jet. As the projectile passes through the combustible mixture, the gaseous mixture flows past the throat, i.e., the largest diameter portion of the projectile, into a diffusion area disposed immediately behind the throat, and burns in a combustion zone proximate the aft portion of the projectile. Combustion of the gaseous fuel proceeds in a forward moving combustion zone, producing an increased pressure which tends to accelerate the projectile down the bore of the tube. The ballistic efficiency may be maintained at a high level by tailoring the gas mixture in the tube so as to keep the projectile Mach number within prescribed limits.

At least five modes of ram acceleration are theoretically possible in the ram accelerator, depending upon the profile of the projectile, its velocity, and other factors. In two of the modes, combustion proceeds at subsonic velocities; in three other modes, a detonation wave attaches to the projectile. One of the subsonic combustion modes is referred to as a "thermally choked mode." A projectile can be accelerated in this mode to supersonic velocities in the range from approximately 0.7 kilometers per second to about 3.0 kilometers per second, i.e., the lower end of the range of velocities, which may be achieved in a ram accelerator. The thermally choked mode may be used to accelerate the projectile in a first portion of the tube, followed by a transition to one of the detonation modes further along the tube, by altering the composition of the gas mixture along the path of the projectile. Muzzle velocities in excess of 12 kilometers per second may thus be achieved. Details of the ram accelerator and of the modes of operation are described in U.S. patent application, Ser. No. 946,439, entitled "Apparatus and Method for Acceleration of Projectiles to Hypervelocities," filed Dec. 23, 1986, which is a continuation of application Ser. No. 623,829, filed June 22, 1984 (abandoned).

Early attempts to operate a laboratory test prototype ram accelerator in the thermally choked mode were unsuccessful. To preaccelerate the projectile to the supersonic velocity (approximately 700 meters per second) required to initiate ram acceleration in the test ram accelerator, compressed helium gas was applied behind a solid plug or sabot. The compressed gas propelled the sabot and the projectile placed in front of it through an evacuated portion of the tube. Once the projectile penetrated the portion of the tube filled with the combustible gas mixture, an on board igniter was provided, which was intended to immediately ignite the mixture, ram accelerating the projectile down the tube in the thermally choked mode. Inevitably, in each of the early attempts to initiate ram acceleration, there was a delay in the ignition of the combustible mixture, and then once ignited, a combustion driven wave rapidly propagated down the tube past the projectile, "unstarting" the flow, i.e., choking the flow past the projectile. In fact, the combustion wave proceeded to ignite the combustible mixture throughout the entire length of the tube, well ahead of the projectile, making it impossible to accelerate the projectile as hoped.

Further testing and research showed that the flow past the projectile was remaining supersonic, and that the supersonic flow was preventing a stable subsonic, thermally choked flow from being established as required. The problem was traced to the fact that it is extremely difficult to ignite and sustain combustion in a supersonic flow.

In consideration of the problems described above, it is an object of this invention to enable stable operation of a ram accelerator in a thermally choked subsonic combustion mode.

A further object is to establish a subsonic flow in the diffusion area behind the throat of a projectile as it initially enters a combustible gas mixture in a ram accelerator.

Yet another object of this invention is to initiate a stable subsonic combustion zone proximate an aft portion of the projectile.

These and other objects and advantages of the invention will be apparent from the attached drawings and the description of the preferred embodiments which follow.

SUMMARY OF THE INVENTION

In a ram accelerator, apparatus and a method are provided for initializing a stable ram propulsion of a projectile along a bore of a tube having at least a portion thereof filled with a combustible mixture of a gaseous fuel and an oxidizer. The projectile is preaccelerated to a supersonic velocity prior to entering the portion of the tube filled with the combustible mixture.

A shock wave caused as the projectile enters the combustible mixture is throttled to insure that its velocity is less than or equal that of the aft portion of the projectile. As subsonic flow is established past the projectile, a stable combustion zone is initiated proximate its aft portion.

In one embodiment, the projectile may be preaccelerated to a supersonic velocity using a compressed gas. In another embodiment, a propellant charge is ignited to preaccelerate the projectile. A port in a wall of the tube, providing fluid communication with ambient pressure, is disposed proximate where the projectile enters the portion of the tube filled with the combustible mixture. At least a portion of a dynamic impulse pressure associated with the shock wave dissipates through the port to reduce the velocity of the shock wave, permitting it to attach to the projectile.

In another embodiment, a perforated sabot is used to propel the projectile into the portion of the tube filled with the combustible mixture. Fluid flow through the perforation is blocked during preacceleration of the projectile, but is enabled after the sabot enters the combustible mixture. At least a portion of the dynamic impulse pressure associated with the shock wave is thus dissipated through the perforation to reduce the velocity of the shock wave.

In yet another embodiment, an explosive pellet is detonated proximate where the projectile enters the portion of the tube filled with the combustible mixture. The explosion of the pellet generates a shock wave of predetermined velocity, stabilizing the combustion zone at the aft portion of the projectile behind the shock wave. Alternatively, a plasma jet injector may be used to generate a shock wave of predetermined velocity, which also attaches along the length of the projectile.

Instead of a perforated sabot, a relatively lightweight sabot having a predetermined kinetic energy may be used, so that it rapidly loses velocity upon entry into the combustible mixture as it quickly falls behind the projectile, throttling the shock wave it produces by rapidly decelerating and losing kinetic energy. A lightweight disk loosely attached to the rear of the projectile provides the same advantage, since it detaches upon entry of the projectile into the portion of the tube filled with the combustible mixture and rapidly falls behind the projectile to throttle the velocity of the shock wave.

BRIEF DESCRIPTION OF THE DRAWINGS

FIG. 2 is a cross-sectional plan view of a portion of the ram accelerator, illustrating the projectile propelled in a thermal choking mode;

FIG. 3 is an elevational view of the aft end of the projectile;

FIG. 6 is an isometric view of a lightweight sabot;

FIG. 7 is an isometric view of a lightweight disk, which is loosely attached to the rear of the projectile;

FIG. 8 is a cross-sectional view of a portion of an embodiment of the ram accelerator, showing the disposition of an explosive pellet in the wall of the tube;

FIG. 9 is a cross-sectional view of a portion of another embodiment of the ram accelerator, showing the disposition of plasma jet injector in the wall of the tube;

DESCRIPTION OF THE PREFERRED EMBODIMENTS

Figures 1, 4, 5, 10:
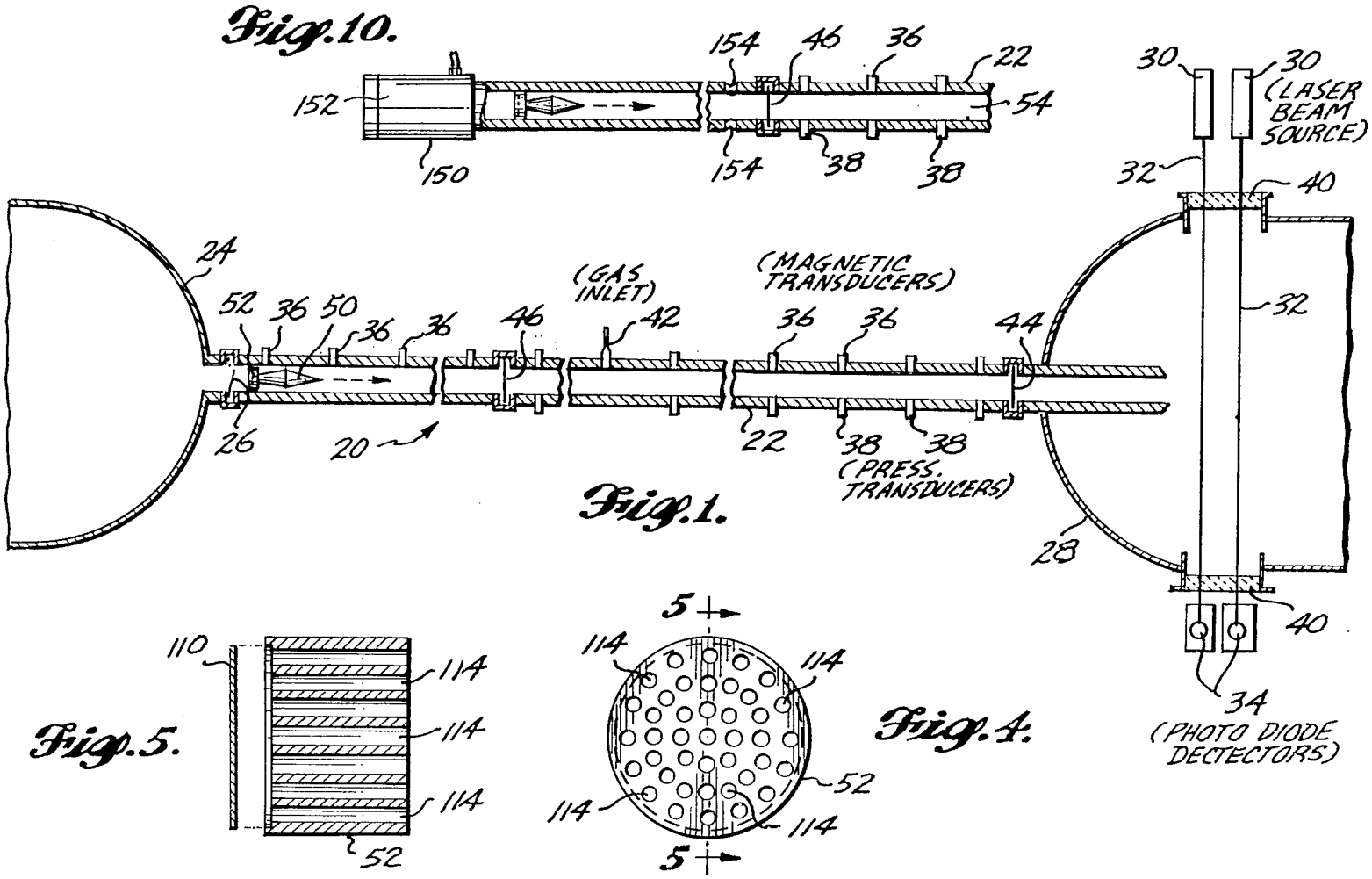
FIG. 1 schematically illustrates the ram accelerator in cross-sectional plan view.
FIG. 4 is an elevational view of the rear of a perforated sabot.
FIG. 5 is a cross-sectional view of the perforated sabot, taken along section line 5—5 of FIG. 4.
FIG. 10 is a cross-sectional view of yet another embodiment of the ram accelerator, in which a chemical propellant charge is used to preaccelerate the projectile.

Much of the work that has been done to date to evaluate feasibility in operation of the ram accelerator has been performed using an experimental ram accelerator substantially like that schematically shown in cross section in FIG. 1, and generally denoted by reference numeral 20. Ram accelerator 20 includes a plurality of end connected tubular sections comprising steel tube 22, having an internal diameter of approximately 38 millimeters and a total length of approximately 12 meters.

A tank 24 filled with compressed helium gas is provided at the breach end of tube 22, in fluid communication with a fast-acting valve 26 (represented schematically in FIG. 1), which is operative to permit flow of the compressed helium into an evacuated portion of tube 22 immediately downstream of valve 26. (With reference to FIG. 1, "downstream" is to the right.) The opposite or muzzle end of tube 22 extends into a vacuum chamber 28 having two view ports 40 disposed on opposite sides thereof. Two laser beam sources 30 are mounted outside vacuum chamber 28 adjacent one of the view ports 40 so that the laser beams 32 which they produce are directed through that view port and across the vacuum chamber along parallel paths that intersect the longitudinal axis of tube 22. Laser beams 32 emerge through the opposite view port 40, impacting on photo diode detectors 34, and producing an output signal useful for determining the velocity of an object as it successively interrupts the two beams.

Vacuum chamber 28 is used in the prototype ram accelerator 20 for instrumentation and observation purposes, to collect data on the free flight of the projectile following ram acceleration, and to contain the expanding gases resulting from combustion of the mixture. In addition, the test facility further includes a target chamber (not shown) to the right of vacuum chamber 28, which is filled with steel turnings or carpet remnants used for absorbing the kinetic energy of the projectile. It should be apparent that neither the vacuum chamber nor the target chamber would be used in an actual ram accelerator intended to launch a projectile from the end of tube 22.

A plurality of magnetic transducers 36 are disposed at spaced apart intervals along the length of tube 22, and are used for determining the incremental velocity of a projectile passing along the bore of tube 22, as explained below. Similarly, a plurality of pressure transducers 38 are disposed at spaced apart intervals along tube 22, to develop data relating to the gasdynamic pressure within the interior of tube 22, during the ram acceleration process.

A gas inlet 42 is connected to tube 22 at an intermediate point along its length, providing fluid communication with a source of premixed gaseous fuel and oxidizer, compressed to super-atmospheric pressure. For example, a combustible mixture 54 of methane and oxygen or hydrogen and oxygen compressed to a pressure from 12 to 50 atmospheres may be injected into the interior of tube 22. Typically, the combustible mixture 54 also includes a diluent such as carbon dioxide, nitrogen, helium or excess fuel. The relative proportion of fuel, oxidizer and diluent affects the range of velocities to which a projectile may be accelerated. The mixture used in the lowest ram acceleration velocity range (690 through 1,260 meters per second) has been $CH_4+2O_2+6\ CO_2$, while the mixture used in the highest velocity range achieved to date (between approximately 1,700 meters per second and 2,400 meters per second) comprises 3.4 $CH_4+2O_2+6.5$ He.

The use of the diluent serves two purposes. It tailors the speed of sound of the combustible mixture so that the projectile Mach number is constrained to the range of approximately 2.5 through 4.5 over the entire velocity range investigated, and it reduces the possibility of the combustion wave developing spontaneously into a detonation wave that bypasses the projectile. Although not shown in FIG. 1, the interior portion of tube 22 that contains the combustible mixture may be divided into a plurality of sections each filled with a combustible mixture of different composition, to achieve even higher ultimate projectile velocities. The combustible mixture 54 is retained within a specific portion of tube 22 by two 14 mil thick MYLAR plastic membranes stretched across the bore of tube 22.

As shown in FIG. 1, a first MYLAR membrane 44 is disposed at the muzzle end of tube 22, where it enters vacuum chamber 28, and a second MYLAR membrane 46 is disposed downstream of the evacuated breach portion of tube 22 in which the projectile is initially preaccelerated to a supersonic velocity.

FIG. 1 illustrates a projectile 50 positioned in the breach portion of tube 22, ready for preacceleration to supersonic velocities. Disposed immediately behind and in contact with the aft end of projectile 50 is a sabot 52. When valve 26 is opened, compressed helium from tank 24 applies pressure to the rear of sabot 52, propelling it and projectile 50 down the bore of tube 22. The compressed, relatively light helium gas is able to accelerate projectile 50 to approximately 700 meters per second prior to impact of the projectile with MYLAR membrane 46. This velocity is well above Mach 1 (where the "Mach number" represents the speed of sound in a gas at a particular density and pressure).

Details of projectile 50 are shown in FIGS. 2 and 3. The body of projectile 50 is machined from magnesium and includes a nose cone section 60 that is threaded into an aft section 64. A ferro-magnetic disk (not shown) is fitted between the two sections and triggers the magnetic transducers 36 as the projectile passes through tube 22. The nose cone section 60 mates with aft section 64 at a circumferential line where the ferromagnetic disk is disposed, defining a throat 62, the largest diameter body portion of the projectile. Aft section 64 further includes four radially aligned fins 66 disposed at 90° intervals around the circumference of the projectile. Fins 66 serve no aerodynamic purpose during the ram acceleration of projectile 50, and are provided merely to center projectile 50 within the bore of tube 22; the overall diameter of projectile 50 measured between opposite fins 66 is slightly less than the interior diameter of tube 22. By comparison, the diameter of the body portion of projectile 50 converges from its largest extent at throat 62 to a smaller diameter at the aft end 68 of the projectile.

FIG. 2 schematically illustrates flow characteristics of the thermally choked subsonic combustion mode of ram acceleration. Dash line 86 represents the leading edge of a bow shock wave propagating with projectile 50 down the bore of tube 22. The velocity of the bow shock wave and of projectile 50 relative to the combustible gas mixture is greater than Mach 1 (indicated by the expression "M>1"). Behind throat 62, there is a diffusion flow zone, and a "normal" shock wave 88 is attached to the body of projectile 50. The normal shock wave is too weak to ignite the combustible mixture 54. The Mach number associated with the flow of combustible mixture behind the normal shock wave 88 is less than one, due to the higher density of the gaseous mixture in that area. Subsonic flow of the combustible mixture 54 past aft portion 64, behind normal shock wave 88, enables a stable combustion zone 90 to develop. As the combustible mixture burns in zone 90, the resulting pressure caused by thermal expansion accelerates projectile 50 down the bore of tube 22. It is believed that the recirculation region at the aft end 68 of the projectile acts as a flame holding "dump combustor" during ram acceleration in the thermally choked mode. However, the shape of the aft end of the projectile may not be critical to operation in the thermally choked mode.

The normal shock wave attached to the projectile is stabilized because the heat release resulting from combustion of the mixture chokes the flow past the projectile in the full tube area behind it. In principle, projectile 50 may reach a velocity in excess of three kilometers per second in the thermally choked mode illustrated in FIG. 2. By changing the relative proportion of the fuel, oxidizer, and diluent components of combustible mixture 54 in tube 22 downstream of where the thermally choked mode is initiated, one of the three detonation modes may be initiated to further accelerate the projectile.

As explained above, early tests of the ram accelerator failed to achieve the desired thermal choking mode of ram acceleration illustrated in FIG. 2. It was determined that once the projectile entered combustible mixture 54 and the mixture ignited, a combustion driven wave propagated down tube 22, passing the projectile and unstarting the flow of the combustible mixture past the projectile. It was speculated that establishing a subsonic flow over the rear of the projectile was necessary to start and maintain a stable combustion zone. Entry of a relatively solid sabot into the combustible mixture 54 immediately behind the projectile generates a shock wave which propagates past the body of projectile 50, unstarting the flow and causing the projectile to decelerate. Accordingly, the perforated sabot 52 shown in FIGS. 4 and 5 was developed as a first solution to this problem. The perforations in the sabot reduced the dynamic impulse pressure of the shock wave generated by entry of the sabot into the combustible mixture, permitting the shock wave to attach to the body of the projectile, causing the flow past its aft portion to be subsonic. It was determined that perforated sabot 52 should be provided with a plurality of passages 114 having a combined cross section comprising from 39% to 41% of the total surface area of the sabot. Passages 114 extend longitudinally from the front surface of the sabot to the rear surface. Clearly, a sabot perforated to this extent would not serve to propel projectile 22 down the bore of tube 50 under the force provided by compressed helium from tank 24, since the helium would leak through passages 114. Accordingly, perforated sabot 52 includes means for sealing passages 114 during the preacceleration of projectile 50, and permitting gas flow through those passages upon entry of the sabot into the combustible mixture. Passages 114 thus provide a gasdynamic choking region behind the projectile so that the projectile experiences subsonic flow along its aft portion, enabling initiation of stable combustion. The means for accomplishing this function in the first embodiment of the present invention include a thin, circular plate 110. This plate seals passages 114 when loosely press fit on the back of perforated sabot 52, so that friction retains it in place. Upon entry of the sabot and projectile 50 into the portion of tube 22 filled with a combustible mixture 54, the shock wave created when the projectile and sabot enter the mixture blows plate 110 clear of sabot 52, opening passages 114. The sabot quickly decelerates so that it no longer participates in the gasdynamic operation. However, while initially decelerating, the perforated sabot holds the flow behind projectile 50 subsonic until a stable combustion zone 90 and thermal choking mode operation is established. Combustion of combustible mixture 54 starts within passages 114, due possibly to compressive heating of the mixture.

After stable combustion and thermal choking mode operation are initiated, the subsequent motion of the sabot has no discernible effect on the ram acceleration process. The sabot may decelerate sufficiently so that it comes to a complete halt or even go into a reverse motion, depending upon the relative mass of the projectile and the sabot, the density and composition of the combustible mixture, and the friction between the sabot and the bore of the accelerator tube 22.

Several other approaches to solving the problem of initiating the thermal choking mode of ram acceleration have also been conceived. In the first of these, as shown in FIG. 6, a sabot 116 (relatively lightweight compared to sabot 52 or to the solid sabot initially used) and having neither perforations nor a detachable backplate is used in preaccelerating projectile 50. The mass of sabot 116 is selected, so that it has a predetermined kinetic energy and decelerates rapidly upon entering the combustible gas mixture in tube 22. As a result, the shock wave it produces as it enters combustible mixture 54 moves up onto the projectile attaching to the aft portion 64, but does not propagate ahead of the projectile throat 62. Alternatively, the kinetic energy of sabot 116 may be fixed at an even lower level so that the shock wave caused by the sabot travels down tube 22 at a moderate distance behind projectile 50. Combustion starts in the subsonic region behind the shock wave as it compresses the combustible mixture and because of the presence of sabot 116, is forced to propagate up the projectile wake, establishing a new shock wave, which attaches to the aft end 68 of the projectile. This new shock wave system replaces the sabot driven shock wave and is maintained in place by thermal choking due to combustion of the mixture.

FIG. 7 illustrates a further embodiment for establishing the thermal choking mode of ram acceleration, wherein a relatively lightweight disk 118 having a depression 120 formed in one surface conforming to the shape of the aft end 68 of projectile 50 is loosely attached to the projectile by press fit of the aft end into the depression. Disk 118 may also be glued or loosely press fit on the aft end of the projectile. A conventional solid sabot may be used in conjunction with a projectile thus equipped with disk 118, if stripped away from the projectile some distance before it enters the portion of tube 22 filled with the combustible mixture 54. Stable combustion is rapidly established behind the projectile, ignition occurring as explained for sabot 116. As stable combustion is achieved, the resulting shock wave propagates forward and attaches to the aft end of the projectile, where it is maintained in its attached position. The disk falls rapidly behind the projectile, and soon has no further effect on the ram acceleration process.

Yet another method of solving the problems associated with initiating the thermally choked mode of ram acceleration is shown in FIG. 8. In this approach, it is assumed that projectile 50 is preaccelerated to a supersonic velocity, as described above, using for example, a sabot that is stripped away from the projectile some distance before the projectile enters the portion of tube 22 filled with a combustible mixture 54, a propellant charge preaccelerator, or some other mechanism to preaccelerate the projectile. If projectile 50 enters the combustible mixture 54 without a sabot following to generate a shock wave having a predefined velocity that will attach to the body of the projectile along its aft portion as shown in FIG. 2, such a shock wave must otherwise be created. To artificially generate such a shock wave, one or more explosive pellets 124 may be ignited. These pellets are disposed in a depression 122 formed on the interior of tube 22 just downstream of MYLAR diaphragm 46. Explosive pellets 124 are ignited by passing an electrical current flow through ignitor leads 126, which extend from the pellets through the wall of tube 22. The explosive pellets ignite the combustible mixture behind the projectile, and generate a normal shock wave 88 that attaches to the aft portion of projectile 50 as shown in FIG. 2, enabling thermally choked flow and formation of a stable combustion zone 90 adjacent the aft end 64 of the projectile.

It may also be possible to ignite combustible mixture 54 and generate a normal shock wave 88 using a plasma jet injector 130 having an injector nozzle 132 extending through the wall of tube 22 at a point just downstream of MYLAR diaphragm 46. Plasma jet injector 130 produces a gaseous jet 138 of charged ionized atoms, which produce a shock wave of predetermined velocity that attaches to the projectile as described above. Gas for the plasma jet injector is supplied through line 134 from a compressed gas source, and may comprise xenon, argon or other suitable ionizable gas. High voltage for the plasma jet injector 130 is provided through leads 136. Although a single plasma jet injector 130 is shown in FIG. 9, it will be apparent that a plurality of such devices may be provided circumferentially around tube 22 as required to generate a shock wave of the predetermined velocity needed to attach to the projectile.

In yet another embodiment shown in FIG. 10, the ram accelerator uses a chemical propellant to preaccelerate projectile 50 through an initial portion of tube 22, in much the same fashion as a projectile shot from a conventional cannon. The chemical propellant preaccelerator 150 includes a breach portion 152 in which the projectile is loaded along with a chemical propellent charge, which is electrically ignited. FIG. 10 illustrates projectile 50 used with a sabot; however, it should be apparent that it may be accelerated without a sabot in this embodiment. A plurality of blast ports 154 extend through the wall of tube 22 just upstream of MYLAR diaphragm 46, in communication with ambient pressure. Blast ports 154 are sized so that the dynamic pressure caused by burning of the propellant partially dissipates to outside ambient, yet sufficient pressure is maintained to generate a normal shock wave that attaches to the projectile as the gases from combustion of the propellant charge follow the projectile into the combustible gas mixture 54. Upon entry of projectile 50 into the combustible mixture, the propellant gases ignite the mixture, and the shock wave created by the propellant gases attaches to the aft portion 64 enabling formation of the stable combustion zone 90 adjacent the aft end 68 of projectile 50.

Ports 154 may also be used in conjunction with the compressed helium preaccelerator shown in FIG. 1. A shock wave created by the sabot entering the combustible mixture 54 dissipates through ports 154, again controlling the velocity of the shock wave generated as the projectile enters the combustible mixture.

In each of the preceding embodiments, the thermally choked mode of ram acceleration is established by throttling the shock wave caused as the projectile enters the portion of the tube filled with the combustible mixture, so that along the aft portion of the projectile, the flow velocity is subsonic. All of the preferred embodiments enable initiation of a stable combustion zone adjacent the aft portion of the projectile that accelerates the projectile along the bore of the tube by either controlling the velocity of a shock wave generated when the projectile enters the combustible mixture, so that it attaches to the aft portion of the projectile, or creating a shock wave of the required velocity. The term "throttling means," as used in this disclosure and in the claims, is intended to encompass both the creation of a shock wave having a desired velocity and dynamic impulse pressure and the control of the velocity and dynamic impulse pressure of any shock wave occurring upon entry of the projectile 50 into combustible mixture 54.

While the present invention has been described with respect to several preferred embodiments, those of ordinary skill in the art will appreciate that further modifications may be made within the scope of the claims that follow hereinbelow. It is therefore not intended that the scope of the invention be in any way limited by the preceding disclosure, but instead should be determined entirely by reference to the claims that follow.

The embodiments of the invention in which an exclusive property or privilege is claimed are defined as follows:

1. In a ram accelerator, including a projectile having an aft portion and a linearly extending tube having a bore, at least a portion of which is filled with a combustible mixture of a gaseous fuel and an oxidizer, apparatus for preaccelerating the projectile, and for initiating a stable combustion zone behind the projectile, comprising:

force generating means for providing a force acting on the aft portion of the projectile so as to accelerate it to supersonic velocity, propelling it into the portion of the tube filled with the combustible mixture; and throttling means that are independent of the projectile and its profile, for controlling the velocity of a shock wave generated at the aft portion of the projectile as the projectile enters the combustible mixture by controlling the dynamic impulse pressure immediately behind the projectile so that the shock wave does not propagate ahead of it, said throttling means causing the shock wave to instead attach to the projectile, thereby establishing a stable subsonic combustion zone along the aft portion of the projectile in which combustion of the gaseous fuel continues to accelerate the projectile down the bore of the tube.

2. The apparatus of claim 1, wherein the force generating means comprise a sabot sized to slide in a close fit down the bore of the tube, said sabot having two opposed surfaces, and a source of compressed fluid applied to one of the two opposed surfaces of the sabot to initially accelerate the sabot, the other of the two opposed surfaces of the sabot engaging the aft portion of the projectile, propelling it down the bore ahead of the sabot.

3. The apparatus of claim 2, wherein the sabot is perforated to provide fluid communication between said opposed surfaces of the sabot, said throttling means including flow control means for closing said perforation while the compressed fluid is accelerating the sabot, and opening said perforation upon entry of the projectile and sabot into the portion of the tube filled with the combustible mixture, so that the dynamic impulse pressure is reduced as the mixture flows through said perforation in the sabot, reducing the velocity of the shock wave generated by the sabot so that it is less than or equal that of the projectile.

4. The apparatus of claim 3, wherein the flow control means comprise a thin plate loosely fitted on the surface of the sabot exposed to the compressed fluid, closing said perforation as the sabot is accelerated by the compressed fluid, said thin plate being detached from the sabot as the sabot enters the portion of the tube filled with the combustible mixture, thereby opening said at least one passage.

5. The apparatus of claim 2, wherein the throttling means comprise a low mass sabot having a kinetic energy that is a function of the velocity and mass of the sabot, the mass of the sabot being predetermined so that its kinetic energy is rapidly dissipated after it enters the portion of the tube filled with the combustible mixture, said sabot rapidly slowing as it enters said portion so that the shock wave generated by the sabot falls behind the projectile, and so that a new shock wave generated by the combustion of the mixture attaches to the projectile in place of the sabot generated shock wave.

6. The apparatus of claim 1, wherein the throttling means comprise an explosive pellet disposed proximate a point where the projectile enters the portion of the tube filled with the combustible mixture, said pellet being exploded to generate a shock wave of predefined velocity as the projectile enters said portion of the tube, thereby causing the shock wave to attach to the projectile at a point along its length.

7. The apparatus of claim 1, wherein the throttling means comprise a plasma jet injector disposed in a wall of the tube proximate where the projectile enters the portion of the tube filled with the combustible mixture, said plasma jet injector generating a shock wave of predetermined velocity as the projectile enters said portion of the tube, thereby causing the shock wave to attach to the projectile.

8. The apparatus of claim 1, wherein the throttling means comprise a port disposed in the tube, upstream of the portion filled with the combustible mixture, said port providing fluid communication between the interior of the tube and an external ambient pressure and thus comprising a passage through which the dynamic impulse pressure of the shock wave is at least partly dissipated.

9. The apparatus of claim 8, wherein the force generating means comprise an explosive powder mixture, which is ignited to accelerate the projectile into the portion of the tube filled with the combustible mixture.

10. The apparatus of claim 8, wherein the force generating means comprise a source of compressed gas.

11. The apparatus of claim 1, wherein the throttling means comprise a relatively lightweight disk loosely attached to the rear of the projectile and having a diameter only slightly less than the bore of the tube, said disk detaching from the projectile as it enters the combustible mixture, falling behind the projectile and throttling a shock wave that results from the ignition of the combustible mixture so that the shock wave attaches to the projectile as the disk enters the portion of the tube filled with the combustible mixture.

12. The apparatus of claim 1, wherein upon entry of the projectile into the portion of the tube filled with the combustible mixture, the throttling means are further operative to cause ignition of the combustible mixture.

13. The apparatus of claim 12, wherein the force generating means include a perforated sabot and means for closing the perforations until the sabot enters the portion of the tube filled with the combustible mixture, said throttling means comprising the perforations in the sabot, compressive heating of the combustible mixture within the perforations causing its ignition.

14. A method for initializing stable ram propulsion of a projectile along a bore of a tube having at least a portion thereof filled with a combustible mixture of a gaseous fuel and an oxidizer, comprising the steps of:

(a) preaccelerating the projectile upstream of said portion of the tube, so that it enters said portion at a supersonic velocity relative to the combustible mixture;

(b) independently of the projectile and its profile, throttling the shock wave caused as the projectile enters said portion of the tube, so that on an aft portion of the projectile, the velocity of the shock wave is approximately equal that of the projectile; and (c) initiating a stable combustion zone immediately behind the projectile, combustion of the mixture in said zone accelerating the projectile along the bore of the tube.

15. The method of claim 14, wherein the projectile is preaccelerated to a supersonic velocity relative to the combustible mixture, before entering said portion of the tube filled with the combustible mixture, using a compressed gas.

16. The method of claim 14, wherein the step of preaccelerating comprises the step of igniting a propellant charge behind the projectile, and wherein a port through a wall of the tube in fluid communication with ambient pressure is provided proximate to where the projectile enters said portion of the tube filled with the combustible mixture, at least a portion of a dynamic impulse pressure associated with the shock wave at the time the projectile enters the combustible mixture dissipating through said port to reduce the velocity of the shock wave to substantially the velocity of the projectile.

17. The method of claim 14, wherein a perforated sabot is used to propel the projectile into said portion of the tube filled with the combustible mixture, further comprising the steps of blocking fluid flow through the perforation during preacceleration of the projectile, and opening the perforation to fluid flow after the projectile has entered said portion of the tube, at least a portion of a dynamic impulse pressure associated with the shock wave being dissipated through said perforation to reduce the velocity of the shock wave.

18. The method of claim 17, wherein compressive heating of the combustible mixture with the perforation ignites the combustible mixture.

19. The method of claim 14, wherein the steps of throttling and initiating the stable combustion zone comprise the step of detonating an explosive pellet disposed in a cavity along the bore of the tube proximate where the projectile enters said portion of the tube filled with the combustible mixture, the explosion of said pellet generating a shock wave of predetermined velocity that attaches to the projectile.

20. The method of claim 14, wherein the steps of throttling and initiating the stable combustion zone comprise the step of activating a plasma jet injector disposed in a wall of the tube proximate where the projectile enters the portion of the tube filled with the combustible mixture, the plasma jet injector generating a shock wave of predetermined velocity that attaches to the projectile.

21. The method of claim 14, wherein a relatively lightweight sabot is used to accelerate the projectile upstream of said portion of the tube, the mass of the sabot being predetermined so that it decelerates upon entry of the projectile and sabot into said portion of the tube filled with the combustible mixture, enabling a peak dynamic pressure associated with the shock wave to dissipate, so that it attaches to the projectile, reducing the velocity of the shock wave to substantially that of the projectile.

22. The method of claim 14, wherein the step of throttling the shock wave includes the step of igniting the combustible mixture.

23. For use in a ram jet accelerator in which a projectile is accelerated to a supersonic velocity prior to entry into a bore filled with a combustible mixture of a gaseous fuel and an oxidizer, a method of establishing a thermally choked mode for propelling the projectile through the bore, comprising the steps of:

(a) independently of the projectile and its profile, controlling the velocity of a shock wave generated as the projectile enters the combustible mixture so that it does not propagate down the bore at a velocity greater than that of the projectile;

(b) creating a subsonic flow over an aft portion of the projectile as it passes down the bore; and (c) initiating a stable combustion zone along the aft portion of the projectile, in which the combustible mixture burns to propel the projectile down the bore.

24. The method of claim 23, wherein the step of controlling the velocity of the shock wave comprises the step of choking flow of the combustible mixture through a perforated sabot initially used to accelerate the projectile.

25. The method of claim 24, wherein compressive heating of the combustible mixture within perforations of the perforated sabot ignites the combustible mixture.

26. The method of claim 23, wherein the steps of controlling the velocity and creating a subsonic flow comprise the step of generating a shock wave of predetermined velocity as the projectile enters the combustile mixture.

27. The method of claim 23, wherein the step of creating a subsonic flow comprises initially accelerating the projectile to a supersonic velocity using a compressed fluid that acts on a lightweight disk to propel the projectile into the bore, further comprising the step of selecting the mass of said disk so that its kinetic energy is sufficiently low to ensure said disk falling behind as the projectile enters the combustible mixture, so that the shock wave attaches to the projectile.

28. The method of claim 27, wherein the disk is loosely attached to the rear of the projectile.

29. The method of claim 23, wherein a propellant charge initially accelerates the projectile to a supersonic velocity relative to the combustible mixture prior to its entry into the combustible mixture.

30. The method of claim 29, wherein a port communicating with ambient pressure dissipates the shock wave as the projectile enters the combustible mixture.

* * * * *